US006899662B2

(12) United States Patent
Gamble et al.

(10) Patent No.: US 6,899,662 B2
(45) Date of Patent: May 31, 2005

(54) CONTOURED PAD FOR SUPPORTING A WEIGHT-LIFTER ON A BENCH

(76) Inventors: Michael L. Gamble, 19452 Greenview, Detroit, MI (US) 48219; Carolyn R. Guy, 19452 Greenview, Detroit, MI (US) 48219

( * ) Notice: Subject to any disclaimer, the term of this patent is extended or adjusted under 35 U.S.C. 154(b) by 218 days.

(21) Appl. No.: 10/236,294

(22) Filed: Sep. 9, 2002

(65) Prior Publication Data

US 2004/0220028 A1 Nov. 4, 2004

(51) Int. Cl.[7] ..... A63B 26/00

(52) U.S. Cl. ..... 482/142; 482/104; 482/105; 482/106; 482/107; 482/108; 128/845; 128/846; 128/869; 128/870; 5/722; 5/902; 5/621; 5/632

(58) Field of Search ..... 482/104–108, 482/142, 134, 44, 92; 128/869–870, 845–846; 5/722, 902, 723, 562, 432, 622, 623, 726, 922, 731, 621, 632, 630, 652, 900.5; 264/45.2; 606/240, 242, 237; 272/123, 144

(56) References Cited

U.S. PATENT DOCUMENTS

| | | | | | |
|---|---|---|---|---|---|
| 5,007,633 | A | | 4/1991 | Lemire | 272/123 |
| 5,304,109 | A | | 4/1994 | Shockley | 482/142 |
| 5,348,523 | A | * | 9/1994 | Blount | 482/104 |
| 6,067,678 | A | * | 5/2000 | Trevino | 5/628 |
| 6,132,338 | A | * | 10/2000 | Shifferaw | 482/30 |

* cited by examiner

*Primary Examiner*—Nicholas D. Lucchesi
*Assistant Examiner*—L. Amerson
(74) *Attorney, Agent, or Firm*—Charles W. Chandler

(57) ABSTRACT

A weight-lifter bench is equipped with a removable body support pad having a multiplicity of body support cavities in the pad upper surface. These cavities mate with rear surfaces of the person's head and torso when the person is in a lithotomy position, e.g. when the person is performing a weight-lifting activity using the bench. The cavity surfaces conform to the body surface contours, such that essentially the entire rear surface of the person's torso is in contact with the pad. The pad provides a comfortable support surface, and an enhanced body support action that tends to minimize the potential risk for injury or fatigue.

2 Claims, 2 Drawing Sheets

CONTOURED PAD FOR SUPPORTING A WEIGHT-LIFTER ON A BENCH

BACKGROUND OF THE INVENTION

This invention relates to a pad placeable on a weight-lifter bench for absorbing the weight of a person in a lithotomy position during the weight-lifting process.

A weight-lifting exercise is frequently accomplished with a bench. The person reclines in a lithotomy position on the bench with his feet on the floor and his head facing upwardly. He raises and lowers a set of barbells with his arms.

One problem with this weight-lifting exercise is that the person's body has only limited contact with the bench; the principal contact areas are the person's head, shoulder blades, and buttocks. Areas out of contact with the bench are unsupported and subject to localized stress during the weight-lifting operation. Such unsupported areas comprise primarily the person's neck, spine, and hips.

U.S. Pat. No. 5,007,633, granted to B. Lemire, suggests that stresses on the weight-lifter's body can be reduced by the use of two transverse pads at specific points along the bench. One pad is positioned underneath the person's neck. A second pad is constructed for placement underneath the lower spinal (lumbar) area of the person. The combination of the two pads effectively increases the support area underneath the person's body, and thus minimizes the risk of injury incident to the weight-lifting exercise.

U.S. Pat. No. 5,304,109 discloses an inflatable flexible pillow (or bladder) usable on a weight-lifter bench underneath the lumbar area of the person to increase the area of support for the person. A hand-operated air pump enables the person to adjust the inflated height of the pillow, in accordance with the most comfortable condition for each particular person using the bench.

SUMMARY OF THE INVENTION

The present invention relates to a pad that can be placed on a conventional weight-lifter bench to provide a comfortable support surface for the body of the person performing the weight-lifting exercise. The pad does not interfere with the exercise; the person uses his customary technique when performing the exercise.

A principal feature of the invention is that the support pad has a multiplicity of cavities in its upper surface adapted to mate with rear surfaces of the person's head and torso. In the preferred practice of the invention, the pad has a first cavity matable with the rear surface of the person's head, second and third cavities matable with the person's shoulder blades, fourth and fifth cavities matable with the person's ribs, and sixth and seventh cavities matable with the person's buttocks.

The principal advantage of the pad cavity system is that the pad achieves a better conformity with the person's body. Essentially the entire rear surface of the person's torso is in contact with the pad when the person is in a lithotomy position during the weight-lifting process. The increased body support area provided by the pad minimizes, localized stresses in particular unsupported parts of the body that could lead to temporary or permanent injury. The increased body support area also is more comfortable for the person; he has a sense or feeling of comfort and safety that enables him to more effectively concentrate on the weight-lifting exercise.

Further features of the invention will be apparent from the attached drawings and description of an illustrative embodiment of the invention.

DESCRIPTION OF THE DRAWINGS

The description refers to the accompanying drawings in which like reference characters refer to like parts throughout the several views, and in which.

DESCRIPTION OF A PREFERRED EMBODIMENT OF THE INVENTION

Figure 1:
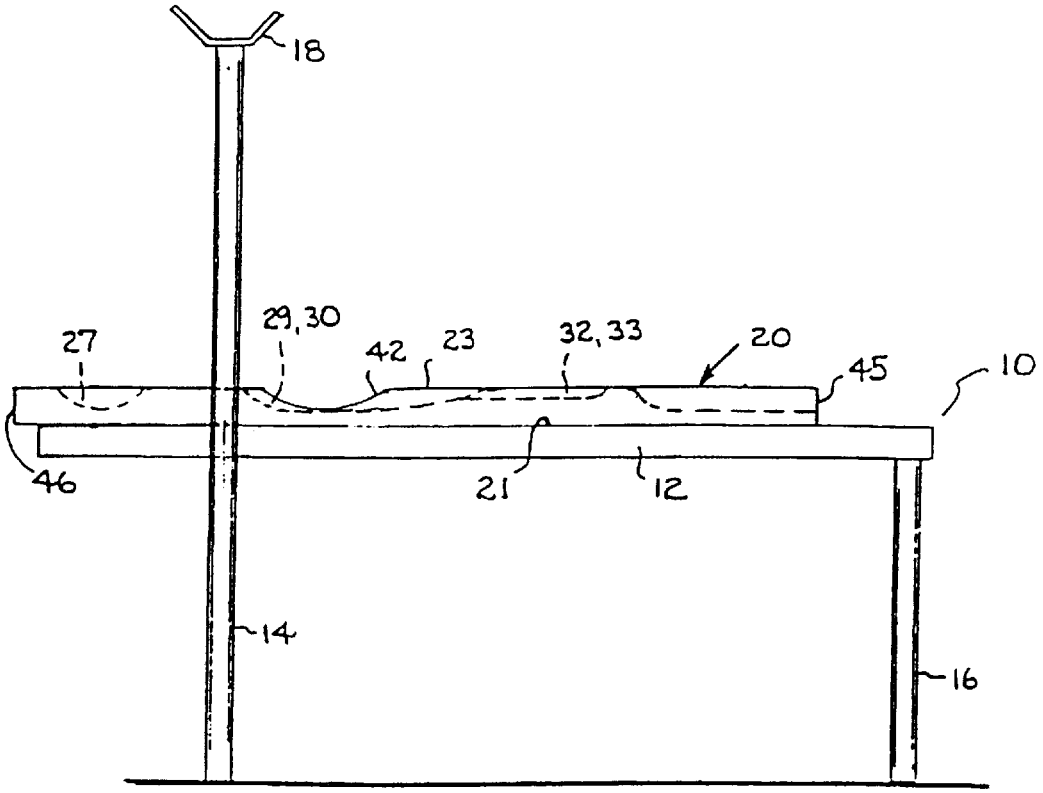
FIG. 1 is a side elevational view of a weight-lifter bench having a body support pad of the present invention installed thereon.
Figure 2:
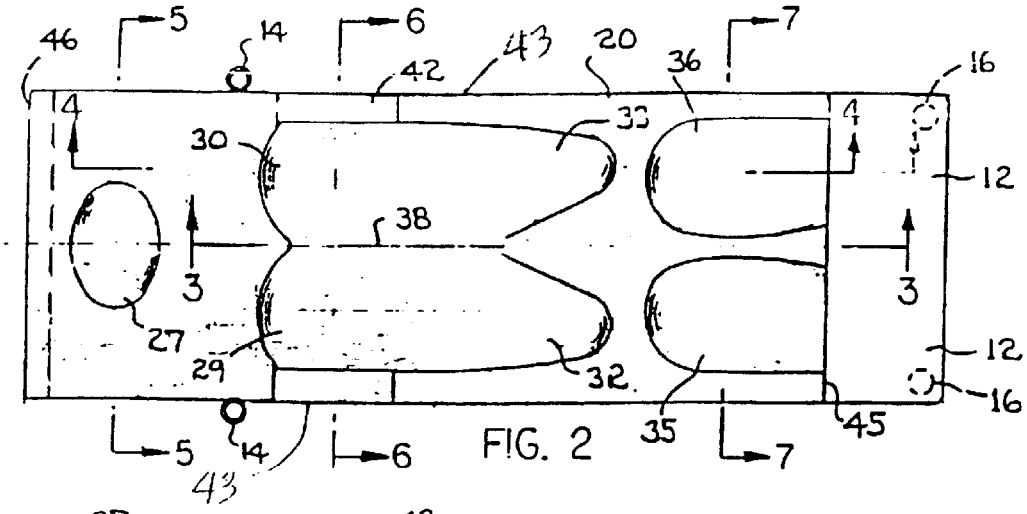
FIG. 2 is a top plan view of the body support pad shown in FIG. 1.

FIG. 1 shows a weight-lifter bench 10 that includes a horizontal rectangular panel 12 attached to two front legs 14 and two rear legs 16. The front legs extend upwardly beyond panel 12 to form two V-shaped cradles 18 for a set of barbells, not shown.

In normal usage of the weight-lifter bench, the person assumes a lithotomy position on panel 12, facing upwardly with his feet on the floor surface proximate to rear legs 16. The person's head is located on panel 12 slightly to the left of the front legs 14, whereby he can raise and lower his arms to accomplish the weight-lifting exercise. The barbell set is supported on the V-shaped cradles 18 when the bench is not in use, but is accessible to the person when he is in the lithotomy position preparing to carry out the weight-lifting exercise.

The present invention relates to a body support pad 20 adapted for placement on the upwardly facing surface 21 of panel 12, such that the person assumes a reclining position on pad 20, rather than on panel 12. The upper surface 23 of pad 20 has a multiplicity of shallow cavities matable with the rear surfaces of the person's head and torso, whereby essentially the entire rear surface of the person's lithectomy body is in contact with the pad. The pad provides extensive area support for the person's body, thereby minimizing the possibility of localized stress concentrations in the body that could lead to fatigue or injury. The person has a comfortable fit on the contoured surface of the pad.

Figure 8:
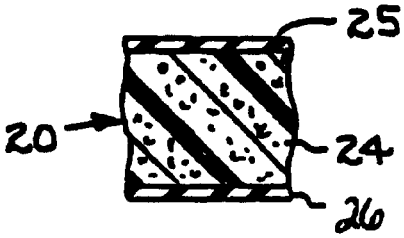
FIG. 8 is a fragmentary enlarged sectional view taken through wall materials that can be used in the body support pad of FIGS. 1 through 7.

FIG. 8 fragmentarily shows an arrangement of wall materials that can be used to form the body support pad depicted in FIGS. 1 through 7. For reasons of cost and weight reduction, pad 20 is preferably formed of a pressed cork 24. The cavity system in the upper surface 23 of the pad is achieved by contouring pressed cork to the desired configuration.

As an optional feature of the invention, pressed cork 24 can be covered with an upper layer of washable, soft rubber 25 or soft imperforate plastic. A bottom layer 26 of a slip resistant latex rubber is fastened to the lower surface of the pad.

The bottom layer prevents pad 20 from slipping off of panel 12. The upper layer provides a relatively soft comfortable body-contact surface, prevents any sweat or moisture generated by the person from passing into the foam core. The upper layer is washable.

The side edges of the pad are open to permit the body to breathe and to provide a comfortable cushion.

The pressed cork core material 24 gives pad 20 a desired rigidity that provides the necessary support for the person's body when the person is in the lithotomy position suitable for carrying out the weight-lifting operation. The pressed cork material is slightly compressible, such that it can reform under the person's weight to achieve continuous support for the person's body.

Referring particularly to FIGS. 1 through 4, the aforementioned multiplicity of shallow cavities includes a first cavity 27 matable with the rear surface of the person's head, second and third cavities 29 and 30 matable with a person's shoulder blades, fourth and fifth cavities 32 and 33 matable with a person's ribs, and sixth and seventh cavities 35 and 36 matable with a person's buttocks.

The pad is positioned on panel 12 of the weight-lifter bench so that cavity 27 is to the left of the front legs 14 of the bench. With such placement of panel 12, the person can assume a lithotomy position with his neck in the plane of front legs 14, whereby the person can reach the barbell set on cradles 18 for performing the weight-lifting exercise.

The cavity surfaces on pad 20 are configured to conform generally with the respective surfaces of an average person's body, whereby the pad provides extensive area support for the person's torso, without large localized gaps between the pad and body or localized depressions of the person's skin. The cavity surfaces preferably have smooth gradual changes in curvature, free from sharp edges or projections. The smooth surface contour is free of rigids or bumps that are sometimes associated with sewn pillows or pads of the type used in aforementioned U.S. Pat. Nos. 5,007,633 and 5,304,109.

Figure 3:
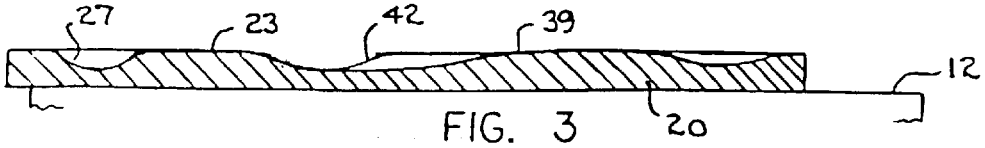
FIG. 3 is a fragmentary sectional view taken on line 3—3 in FIG. 2.
Figure 4:
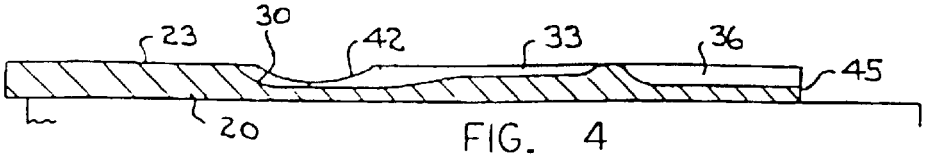
FIG. 4 is a fragmentary section view taken on line 4—4 in FIG. 2.
Figure 5:
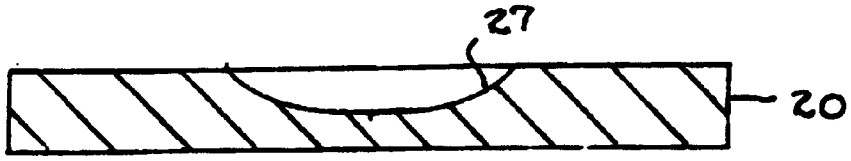
FIG. 5 is a transverse sectional view taken on line 5—5 in FIG. 2.
Figure 6:
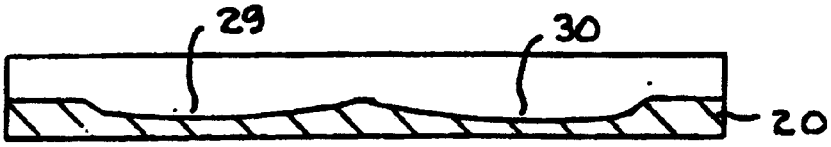
FIG. 6 is a transverse sectional view taken on line 6—6 in FIG. 2.
Figure 7:
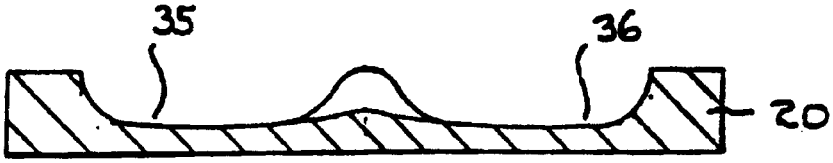
FIG. 7 is a transverse sectional view taken on line 7—7 in FIG. 2.

The upper surface of pad 20 along its longitudinal centerline 38 has a sinuous contour, as shown at 39 in FIG. 3, whereby the pad surface conforms to the spinal contour of an average user of the equipment. Head support cavity 27 is located on the centerline 38. The other cavities are offset to the left or right of centerline 38, as shown in FIG. 3. Thus, cavities 29, 32 and 35 are offset in one direction from centerline 38, whereas cavities 30, 33 and 36 are offset in the opposite direction from centerline 38. The length of pad 20 is slightly less than the length dimension of the bench.

To enable the person to have relatively free up-and-down motion of his shoulders while performing the weight-lifting exercise, the upper surface of pad 20 has two arcuate concave recesses 42 extending between the shoulder blade cavities 29, 30 and the longitudinal side edges 43 of pad 20. The arcuate recesses have approximately the same depth as cavities 29 and 30 to facilitate free movement of the person's shoulders.

The buttocks cavities 35 and 36 extend longitudinally generally parallel to centerline 38 to end 45 of pad 20, such that the person's legs can extend out of cavities 35 and 36 without upward deflections of the leg rear surfaces. The person's legs can assume natural positions, while the buttocks are adequately, and comfortably supported by the surfaces of cavities 35 and 36. Cavities 35 and 36 are in open communication with end 45 of pad 20.

Head support cavity 27 is located relatively close to end 46 of pad 20 in order to minimize the overall length of the pad. Typically, the pad has an overall length of about thirty nine inches.

A single pad 20 size and configuration can be used by a wide range of users (persons). However, it is possible to offer alternative pad sizes and cavity configurations that may appeal to different persons. Shorter persons may feel that a shorter pad having a closer cavity spacing and smaller cavity size is more comfortable than a longer standard pad. The pad commercialization effort could include the concept of the person trying out different size pads to determine the most comfortable pad for each person. The pad construction is relatively simple and economical, such that some persons could afford two different size pads.

The drawings show specific forms and surface contours that can be used in practice of the invention. However, it will be appreciated that the invention can be embodied in various different materials, shapes and arrangements.

Having described our invention, we claim:

1. A support structure for a weight-lifter, comprising:

a weight-lifter bench having an upwardly facing surface;

an elongated pad adapted for placement on said upwardly facing surface; said pad comprising an upper surface having a multiplicity of cavities therein matable with the rear surfaces of a person's head and torso, whereby essentially the entire rear surface of the person's torso is in contact with the pad when the person is in a lithotomy position during the weight-lifting process;

said multiplicity of cavities comprising a first cavity matable with a person's head, a second and a third cavity matable with a person's shoulder blades, a forth and a fifth cavity matable with a person's ribs, and a sixth and a seventh cavity matable with a person's buttocks;

said pad having a longitudinal centerline;

said first cavity being located on said centerline;

said second, fourth and sixth cavities being offset in one direction from said centerline;

said third, fifth and seventh cavities being offset in an opposite direction from said centerline; and said pad having two longitudinal side edges equidistantly spaced from the pad longitudinal centerline; and two arcuate concave recesses connecting said second and third cavities to said longitudinal side edges; said concave recesses having approximately the same depth as said second and third cavities, for accommodating the person's shoulders.

2. A support structure for a weight-lifter, comprising:

an elongated pad adapted for removable placement on the upwardly facing surface of a weight-lifter bench;

said pad comprising an upper surface having a multiplicity of cavities therein matable with the rear surfaces of a person's head and torso;

whereby essentially the entire rear surface of the person's torso is in contact with the pad when the person is in a lithotomy position during the weight-lifting process;

said multiplicity of cavities comprising a first cavity matable with the rear surface of a person's head, a second and a third cavity matable with a person's shoulder blades, a fourth and a fifth cavity matable with a person's ribs, and a sixth and a seventh cavity matable with a person's buttocks;

said pad having a longitudinal centerline;

said first cavity being located on said centerline;

said second, fourth and sixth cavities being offset in one direction from said centerline;

said third, fifth and seventh cavities being offset in an opposite direction from said centerline;

said pad having two longitudinal side edges equidistantly spaced from the pad longitudinal centerline; and two arcuate concave recesses connecting said second and said third cavities to said longitudinal side edges; and said concave recesses having approximately the same depth as said second and third cavities, for accommodating the persons shoulders.

* * * * *